United States Patent [19]

Westdale et al.

[11] 4,430,413

[45] Feb. 7, 1984

[54] METHOD OF MAKING A SINGLE COMPONENT TONER

[75] Inventors: Virgil W. Westdale, Barrington; James L. Hanrahan, Mt. Prospect, both of Ill.

[73] Assignee: AM International, Inc., Chicago, Ill.

[21] Appl. No.: 362,536

[22] Filed: Mar. 26, 1982

[51] Int. Cl.[3] ..... G03G 9/08; G03G 9/14

[52] U.S. Cl. ..... 430/137; 430/106.6; 430/111; 430/903

[58] Field of Search ..... 430/106.6, 111, 137, 430/903

[56] References Cited

U.S. PATENT DOCUMENTS

| | | | |
|---|---|---|---|
| 3,345,294 | 10/1967 | Cooper | 430/106.6 X |
| 4,082,681 | 4/1978 | Takayama et al. | 430/137 X |
| 4,189,390 | 2/1980 | Poguchi et al. | 430/903 X |
| 4,256,818 | 3/1981 | Blossey et al. | 430/106.6 X |
| 4,288,519 | 9/1981 | Diamond et al. | 430/137 |

FOREIGN PATENT DOCUMENTS

| | | | |
|---|---|---|---|
| 55-96960 | 7/1980 | Japan | 430/137 |
| 56-1951 | 1/1981 | Japan | 430/106.6 |

*Primary Examiner*—Roland E. Martin, Jr.

*Attorney, Agent, or Firm*—Nicholas A. Camasto; Donald C. Kolasch

[57] ABSTRACT

An improved process for preparing a single component toner or developer composition is disclosed whereby toner fines are removed from the composition prior to the addition of conductive carbon followed by a reclassification step to remove excess carbon particles, i.e., those carbon particles not attached to the toner.

7 Claims, 1 Drawing Figure

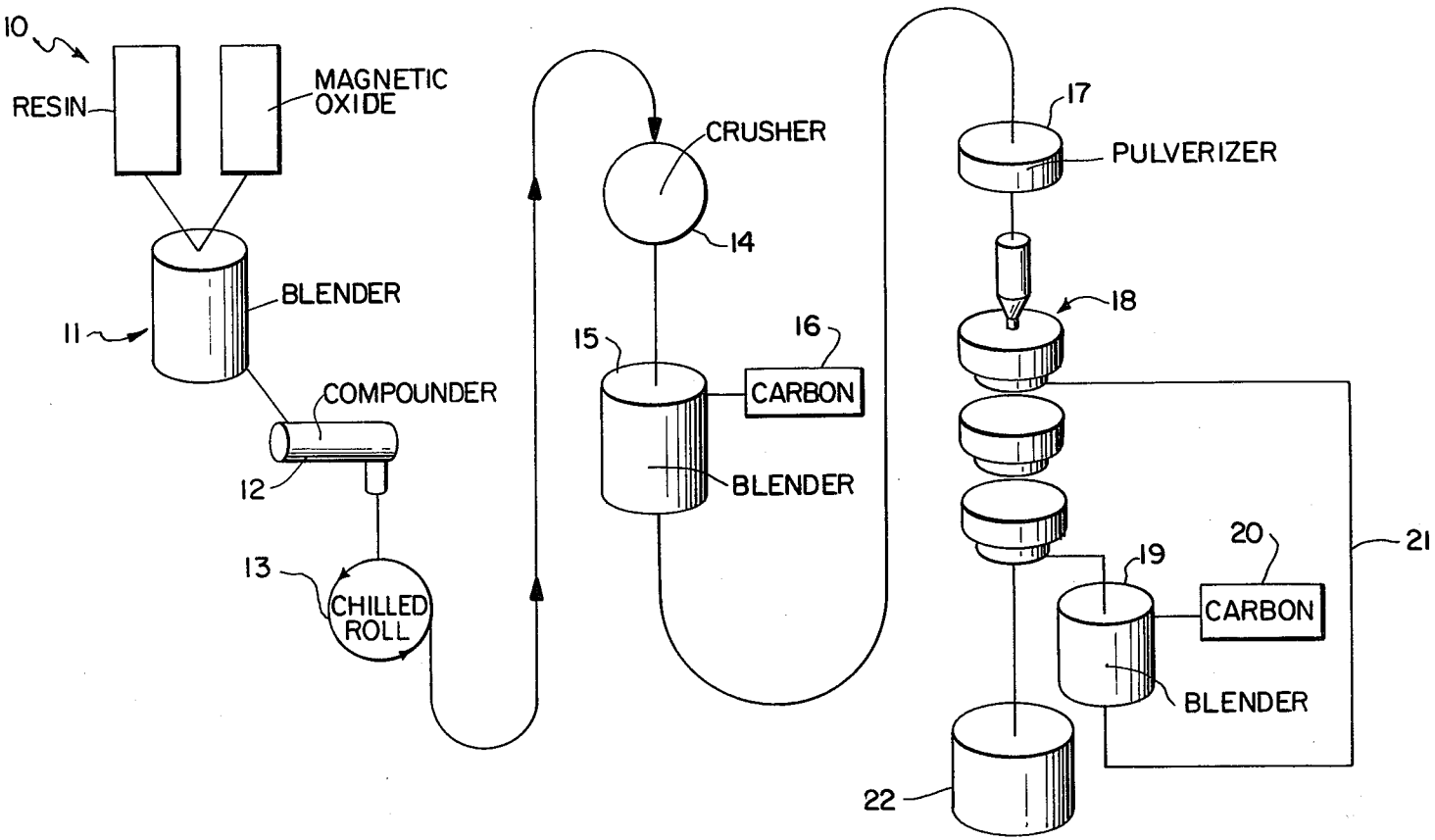
10
RESIN
MAGNETIC OXIDE
11
BLENDER
COMPOUNDER
12
13
CHILLED ROLL
CRUSHER
14
15
16
CARBON
BLENDER
17
PULVERIZER
18
19
20
CARBON
BLENDER
21
22

METHOD OF MAKING A SINGLE COMPONENT TONER

BACKGROUND OF THE INVENTION

The present invention relates to an electrophotographic imaging system and, more specifically, to a method for making a heat-fusible single component toner composition used for the development of electrostatically formed latent images.

In electrophotographic printing, generally a uniform electrostatic charge is applied to a photoconductive insulating layer and the resulting charged surface selectively exposed to electromagnetic radiation so as to dissipate the charge in those areas exposed to the radiation, thereby producing an electrostatic latent image. The resulting latent image is subsequently developed by depositing a finely divided electroscopic developer material, referred to as toner, on the electrostatically formed image. Generally speaking, the charged toner particles will have a charge opposite to the residual electrostatic charge image so that the toner particles adhere to the charged areas to form a visible image. This image may be fixed in situ on the support or transferred to a secondary support surface and the transferred image permanently affixed to the secondary support surface.

Two component developer mixtures are conventionally used to develop the images comprising a pigmented resinous toner powder and a carrier component wherein the carrier component is substantially larger in size than its toner complement. The toner particles, which are generally made up of a fine pigmented resinous material, are charged triboelectrically by rubbing against the carrier particles causing them to adhere electrostatically thereto. The composition of the developer mix is chosen such that the toner particles will acquire an electrostatic charge of a polarity opposite to that of the electrostatic image to be developed. As a result, when the developer is brought into contact with the electrostatic latent image, the toner particles are attracted from the carrier particles and selectively deposited onto the electrostatic image by the electrostatic charge of the image. The powder or toner image that is obtained is either fixed in situ on the surface of the image-bearing substrate or the powder image selectively transferred to a receiving surface to which it is then fixed. The fixing process can reflect any one of several approaches such as pressure fixing, vapor fixing or heat fusing, depending upon the specifics of the particular system. In another form of development utilizing a developer mix comprising a carrier and toner component, a developer composition containing toner and magnetic carrier particles is transported by a magnet. The resulting magnetic field causes alignment of the magnetic carrier into a brush-like configuration. This magnetic brush is engaged with the electrostatic image-bearing surface, and the toner particles supported on the brush-like configuration, are drawn from the "brush" to the latent image by electrostatic attraction. Thus, a developer mixture may be provided comprising a toner material and a carrier material which consists of particles which are magnetically attractable. Such a configuration is generally referred to as a magnetic brush development system.

Although the above development systems have been found useful in electrophotography, they are not without their disadvantages. For example, in the use of a developer mix comprising both the toner and carrier components, in combination with a heat-fusible image fixing system, mix fatique is encountered which generally results in poor copy images and the masters produced therefrom have relatively short periods of usage time. The carrier component slowly is reduced in size and becomes increasingly coated with toner, producing a resulting change in the triboelectric charge relationship, thus, leading to a lower quality image. Furthermore, in the reproduction of high-contrast copies utilizing the powder-carrier developer mix wherein the mutual electrification of the components is governed by the distance between their relative positions in the triboelectric series, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. It is, therefore, readily apparent that many materials which otherwise have suitable properties for employment as carrier particles are unsuitable because they possess unsatisfactory triboelectric properties. In addition, uniform triboelectric surface characteristics of many carrier surfaces are difficult to achieve with mass production techniques.

Heretofore, a single component toner material has been provided for use in combination with pressure-fusing systems which eliminates the need for the presence of the carrier component, with a certain degree of success, since the toner, as a result of its formulation, including a magnetic component, serves as its own carrier and, thus, is useful in the development of electrostatic latent images in electrophotography. However, due to the preferred use of heat-fusing techniques in fixing the resulting developed image to produce a more reliable and permanent image, it is preferred to utilize a single component toner material which is compatible with a heat-fusing system so as to enhance the results of the specific electrophotographic imaging system.

In the preparation of the single component toners comprising a polyamide resin which is suitable for use in combination with a heat-fusing system, it has been determined that improved methods of manufacturing must be devised. Although generally applicable processes are presently known for the preparation of the polyamide developer composition herein defined, the presently known processes are not without their disadvantages. For example, heretofore, the presence of excess unattached carbon in the toner composition has had a detrimental effect upon the ensuing image development process. In addition, generally the final processing of single component toner compositions entailed several steps which are considered more involved than the processing of more conventional two component developer systems. One such process limitation requires the rounding of the toner particles to increase the powder flow. The realization of this treatment effect required complex fire polishing techniques and other process variations which inherently increase the complexity of the overall system. The addition of conductive carbon to the toner particle surface to effect its resistivity has also been found wanting.

Therefore, it is an object of the present invention to provide a method of manufacturing a single component developer composition which will overcome the above-noted and other disadvantages.

It is a further object of the present invention to provide an improved method for manufacturing a magnetic oxide containing single component developer composition for use in an electrophotographic imaging process.

Another object of the present invention is to provide an improved method in the preparation of a single component developer composition which eliminates the presence of excess, unattached carbon in the resulting toner composition.

A further object of the present invention is to provide a single component toner composition comprising a highly conductive carbon pigment.

Yet, a further object of the present invention is to provide an improved method for preparing a single component developer composition which effectively regulates the conductivity or resistivity properties of the resulting toner particle.

Still a further object of the present invention is to provide an improved method in the preparation of a single component developer composition having enhanced flow properties.

SUMMARY OF THE INVENTION

The foregoing objects and others are accomplished in accordance with the present invention, generally speaking, by providing a mixture of a polyamide resin having a sharp melt point and low melt viscosity and a magnetic oxide material generally present in an amount ranging from 40 to 75 percent by weight of the developer mixture. The magnetic oxide component and the polyamide resin are placed in a conventional dry blender and thoroughly blended before introducing into a compounder. The magnetic oxide component is introduced into the resin having an original particle size of about 0.1$\mu$ to 3.0$\mu$. After dry blending the two components, the resulting blend is heated to a temperature of about 220° F. to 255° F. to melt the polyamide resin and form a homogeneous melt which is compounded by the compounder, subsequently chilled to solidify the resulting compound, chipped and crushed to a particle size of about one-eighth of an inch and then introduced into a second dry blender to which is added from about 0.5 to 1 percent of a conductive carbon. The carbon and magnetic oxide-polyamide resin composition is blended for about twenty seconds, in a high intensive mixer, intermittently mixing the carbon therewith. The resulting composition or blend is next introduced into a pulverizer wherein the composition is milled and reduced in size to 45 microns or less. At this stage in the process, the resulting pigmented toner composition is classified so as to remove substantially the unwanted fine or small particles, that is, those less than 8 microns. It is preferred that the resulting toner particles of the present invention be present in the final developer composition in a size ranging from 8 to 40 microns in diameter and preferably 12.0 l to 35.0 microns. Thus, particles of toner having sizes smaller than this range are desirably removed from the developer composition. The system will tolerate particle sizes ranging from 6 to 8 microns, preferably in an amount up to a maximum of about 1 percent. It is preferred that at least 90 percent of the developer composition be comprised of particles ranging from 12 to 35 microns in diameter. The classified toner composition is next introduced into a third blender wherein carbon particles having the desired conductivity are further blended with the developer composition to produce the desired end product containing up to 4.0 percent of the conductive carbon of the present invention. The initial classification step is highly significant since, by removing the unwanted size of toner particles, more of the conductive carbon can be effectively applied to the surface of the toner particles, thus producing a more desirable product. If a large number of small unwanted toner particles are present in the particle system during the addition of the carbon or other additives and subsequently removed after the carbon is applied, then the unwanted particles would interfere significantly with the effective deposit of the conductive carbon to the surface of the preferred toner particles. Thus, according to the process of the present invention, the small unwanted particles are eliminated before the final carbon application. The addition of the carbon particles increases the fluidity of the toner particles during processing by decreasing resistance to flow, thus making movement of the material within the system easier and enhancing the addition of application of the carbon or other selected additives to the toner surface.

The carbon additive is blended during the second addition for a period of about two minutes in a high-intensity blender and then reclassified to further remove the excess carbon particles, i.e., those particles failing to be embedded into the surface of the toner particle.

It has been determined in the course of the present invention that a single component developer composition or toner comprising a pigmented polyamide resin and a magnetic oxide additive exhibiting the necessary characteristics which permit the toner to be used in an electrostatic imaging system, having improved quality can be obtained by removing the toner fines by classification, before the substantial addition of carbon to the toner particles, and then reclassifying the resulting composition after the carbon addition to remove excess carbon particles.

DETAILED DESCRIPTION OF THE INVENTION

In accordance with the present invention, the resinous component of the developer powder or toner is composed, in at least a major part, of polyamide resins having a low melt viscosity and sharp melting points within the range of from about 70° up to about 165° C., preferably within the range of from about 97° up to 107° C. As used herein, the term polyamide resin refers to the polymerization product resulting from the condensation of polyamines with polybasic acids. In general, any polyamide resin produced according to the reaction set forth above may be used in the present invention, providing the melting point of the final resin composition is within the range specified, preferably within the range of 97° to 107° C. Below 70° C. there is a danger of the resin melting at the normal operating temperature of the electrophotographic apparatus, bearing in mind also that the toner compositions must withstand any high temperature that may be encountered during shipping without producing cold flowing. The sharp melting point polyamide resins reduce this cold flow tendency inasmuch as they do not soften unless the environmental temperature approaches very near to their melting temperature. Thus, the melt temperature of the polyamide resin utilized is maintained substantially above any shipping temperature which is contemplated. Temperatures above the upper limit would generally lead to charring of the imaged copy sheets and are obviously undesirable.

Any suitable polyamide resin which satisfies the above requirements may be used in the course of the present invention. Typical polyamide resins are the Versamid 335, 712, 750, 930, 940 and 950 resins commercially available from Henkel Corporation and Polymid P-1155, P-4771 and P-1074, commercially available from the Lawter Chemical Company. It should also be appreciated that polyamides having melting points outside the stated range, such as Polymid 1084 available from the Lawter Chemical Company, may be used if combined with other polyamides so that the final resin composition has the desired melting point. Thus, a Versamid 100 resin, which has a melting point of 43° to 53° C., or a Versamid 900 resin, which has a melting point of 180° to 190° C., may be combined with other polyamides to produce a polyamide composition having a melting point within the operating range of 70° to 165° C. The low melt viscosity resins, such as the P-4771 resin, are preferred for their flow characteristics including viscosities of 1000 centipoises or less at their melting temperatures. The low melt viscosity resins greatly aid in the fusing of toner images at surface temperatures of from 215° to 225° F.

As referred to above, a highly conductive carbon pigment is added to the developer powder or toner in order to provide the particles with a surface coating which will render them somewhat conductive so as to decrease the resistivity of the particle and enhance powder flow during processing. Other pigment materials may be used in combination with the conductive carbon pigment in order to produce various desired effects. The carbon particles will generally have a size ranging from 12 mμ to 22 mμ and will be added to the toner composition in an amount ranging from 0.5 to 4.0 percent, preferably 0.75 to 1.2 percent, by weight based on the total weight of the toner. The conductive carbon is added to the toner or developer composition to impart thereto a resistivity ranging from 50 ohm-cm to $1\times10^5$ ohm-cm and preferably $1.0\times10^2$ ohm-cm to $1.0\times10^3$ ohm-cm, to achieve the desired conductivity. Typical highly conductive carbon particles suitable for use in the present invention include Columbian CC40-220 commercially available from the Columbian Chemicals Co., Vulcan XC-72R commercially available from the Cabot Corp., and Printex L commercially available from the DeGussa Corp.

Any suitable magnetic oxide component may be added to the resinous toner composition which imparts the desired effect to the single component developer of the present invention. Typical magnetic oxide materials include $Fe_2O_3$, $Fe_3O_4$ and various other forms of magnetite. The magnetic oxide component is present in the toner composition in an amount ranging from about 40 to 75 percent by weight, and preferably from about 50 to about 70 percent, in order to achieve effective development and wetting properties. In such formulations the amount of polyamide resin present will range from about 60 to 25 percent by weight, and preferably 40 to 30 percent, always allowing for the presence of the pigment component for control of conductivity as described above.

The resulting developer or toner particles of the present invention are preferably classified so as to be present in the final developer composition in a size range ranging from 8.0 to 40.0 microns, and preferably 12.0 to 35.0 microns in diameter. Particle sizes ranging from 6 to 8 microns may be present up to a maximum of about 1 percent, and it is preferred that at least 90 percent of the final developer composition have a toner particle size in the 12 to 35 micron range.

As previously discussed, the carbon is blended with the crushed particles for a period of time which allows for the desired coating of the surface of the particles, a period generally of about 20 seconds. Adding the conductive carbon significantly aids in the processing steps to follow in decreasing resistance to flow as the carbon imparts the desired conductivity requirements by decreasing the resistivity of the resulting particles. The resulting blend is then introduced into a pulverizer for reducing the toner composition to the desired particle size while, at the same time, effectively embedding the carbon material in the surface of the toner particles by impaction. The pulverizing step reduces the particle size of the toner particles to a desired range of between about 8 to 40 microns, with a range of 12 to 35 microns being the most desirable. The resulting pulverized toner particles are passed through a classification system, wherein the finer toner particles, that is, those less than about 8 microns, are removed so as to present in the final developer composition a content of less than 1 percent by weight of particles ranging from 6 to 8 microns. This classification step is highly significant inasmuch as the resulting classified particles are then introduced into a blender to which is added additional conductive carbon particles, which are effectively applied to the surface of the toner particles of the desired particle size. The smaller, undesirable particles, having been substantially removed, are not present during the final carbon additive step and, thus, are not present to interfere with the final deposition of carbon on the particle surface of the selected toner particles. The final carbon additive is applied to the toner system by blending for about 2 minutes in a high intensive blender, and then the resulting blend reclassified so as to remove excess carbon particles. Thus, according to the present invention, the toner fines are classified out of the developer blend before the final addition of carbon to the toner particles and then classified once again after the carbon addition to eliminate any excess, unattached carbon.

It has been determined that the preliminary classification step is essential to the improvement of performance of the single-component toner system. As a result thereof, there is an increase in density of the image, the results thereof being attributed to the fact that the carbon additive is applied almost exclusively to particles useful in the development system, that is, those of the preferred particle size and is most effective in improving powder flow and the conductivity requirements of the resulting toner powder. The greater portion of the small unwanted toner particles having been removed, they are not present so as to interfere with the carbon addition to the surfaces of the larger magnetic oxide-resin toner particles. This procedure also generally reduces background in the ensuing development process and increases image density and sharpness, particularly with the addition of the further classification step following the carbon addition. The disclosed process eliminates heretofore utilized time-consuming and costly procedural requirements in producing increased powder flow and increasing the amount of conductive carbon attached to the desired toner particle surface.

The process of the present invention in the preparation of the developer composition is further illustrated by way of the accompanying drawing.

Referring now to the instant process 10, the polyamide resin of the present invention is blended with the magnetic oxide particles, which have been previously reduced to the desired particle size, by blender 11 wherein they are thoroughly mixed and then introduced into compounder 12, where the resulting mixture is heated to a temperature of about 105° to 124° C. to melt the polyamide resin and form a homogeneous melt of the resin and magnetic oxide. The mixture is next directed to a chilled roll 13 which cools and hardens the resin-oxide mixture which is then introduced to a crusher 14 for grinding to the initial crushed particle size, ranging up to about one-eighth of an inch in diameter. The crushed particles are then introduced into a dry blender 15 to which a conductive carbon 16 is blended. The resulting pigmented developer composition is next introduced into a pulverizer 17 and the developer particles ground to a size of less than 45 microns. The pulverized particles are then introduced into a series 18 of classifiers so as to substantially remove small particles of toner less than 8 microns. The classified product is then introduced into blender 19 to which additional conductive carbon particles 20 are added to finalize or adjust the toner particles to the proper resistivity. The particles are then reintroduced into the classification system via channel 21 to remove and eliminate any excess unattached carbon. The first classification step is highly significant in that the toner fines are classified out of the composition which enhances the addition of the carbon to the toner particles of desired size and further reclassified to remove the excess carbon particles which, if present, would increase the observed background of the developed image. The final product is discharged into tank 22.

The process as above illustrated may be modified in such a way so that the toner fines are classified out of the magnetic oxide-resin blend prior to the addition of any of the conductive carbon particles to the toner particles, thus eliminating blender 15 and carbon 16. In addition, polyamide resins of varying melting points may be blended such that a polyamide having a melting point which is generally considered outside of the operable range may be blended with a polyamide resin suitably within the desirable range, such that the resulting resin mixture exhibits a melting point within the operable range.

The invention being thus described, it will be obvious that the same may be varied in many ways. Such variations are not to be regarded as a departure from the spirit and scope of the present invention, and all such modifications as would be obvious to one skilled in the art intended to be included within the scope of the following claims.

What is claimed is:

1. A process for preparing an electrophotographic single component developer composition which comprises:

providing a blend of a low melt viscosity polyamide resinous material having a melting point within the range of from about 60° to 165° C. and a melt viscosity of 1000 centipoises or less having incorporated therein a magnetic oxide component in an amount ranging from about 40 to 75 percent by weight;

processing said blend so as to produce a particulate developer composition containing developer particles ranging in size up to about 40 microns;

classifying said particulate developer composition so as to remove therefrom substantially all of the fine developer particles present therein having a size of up to about 8 microns;

blending said classified developer particles with conductive particles with conductive carbon particles such that said conductive carbon is present in an amount of from about 0.5 to 4.0% of said composition so as to effectively incorporate said carbon particles onto the surface thereof said developer particles having a resistivity of from 50 ohm-om to $1.0\times10^5$ ohm-cm; and reclassifying said developer particles so as to remove from said developer composition excess carbon particles present therein which are not attached to said developer particles.

2. The process of claim 1, wherein said final developer composition has a maximum of about 1 percent of toner particles having a size of about 8 microns or less.

3. The process of claim 1, wherein said classified developer composition comprises about 90 percent of toner particles ranging from 12 to 35 microns in diameter.

4. The process of claim 1, wherein said resistivity ranges from $1\times10^2$ ohm-cm to $1\times10^3$ ohm-cm.

5. The process of claim 1, wherein said prepared developer composition comprises developer particles which range in size from about 8 to 40 microns.

6. The process of claim 1, wherein up to 1 percent of conductive carbon particles are blended with said developer composition prior to said processing step.

7. The process of claim 1, wherein said conductive carbon particles generally have a size ranging from 12 to 22 mμ.

* * * * *